US006975193B2

(12) United States Patent
Knieser et al.

(10) Patent No.: US 6,975,193 B2
(45) Date of Patent: Dec. 13, 2005

(54) MICROELECTROMECHANICAL ISOLATING CIRCUIT

(75) Inventors: Michael J. Knieser, Fortville, IN (US); Richard D. Harris, Solon, OH (US); Robert J. Pond, Doylestown, OH (US); Louis F. Szabo, Broadview Heights, OH (US); Frederick M. Discenzo, Brecksville, OH (US); Patrick C. Herbert, Mentor, OH (US); Robert J. Kretschmann, Bay Village, OH (US); Mark A. Lucak, Hudson, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 3 days.

(21) Appl. No.: 10/397,096

(22) Filed: Mar. 25, 2003

(65) Prior Publication Data

US 2004/0189142 A1 Sep. 30, 2004

(51) Int. Cl.[7] ..... H01N 51/22
(52) U.S. Cl. ..... 335/78; 200/181
(58) Field of Search ..... 335/78; 200/181

(56) References Cited

U.S. PATENT DOCUMENTS

| | | | |
|---|---|---|---|
| 3,886,447 | A | 5/1975 | Tanaka |
| 4,560,953 | A | 12/1985 | Bozio |
| 5,012,207 | A | 4/1991 | Edwards |
| 5,025,346 | A | 6/1991 | Tang et al. |
| 5,194,819 | A | 3/1993 | Briefer |
| 5,243,861 | A | 9/1993 | Kloeck et al. |
| 5,343,157 | A | 8/1994 | Deschamps |
| 5,359,893 | A | 11/1994 | Dunn |
| 5,399,232 | A | 3/1995 | Albrecht et al. |
| 5,413,668 | A | 5/1995 | Aslam et al. |
| 5,417,312 | A | 5/1995 | Tsuchitani et al. |
| 5,424,650 | A | 6/1995 | Frick |
| 5,491,604 | A | 2/1996 | Nguyen et al. |
| 5,536,988 | A | 7/1996 | Zhang et al. |
| 5,563,343 | A | 10/1996 | Shaw et al. |
| 5,572,057 | A | 11/1996 | Yamamoto et al. |
| 5,578,528 | A | 11/1996 | Wuu et al. |
| 5,585,311 | A | 12/1996 | Ko |
| 5,600,190 | A | 2/1997 | Zettler |
| 5,646,432 | A | 7/1997 | Iwaki et al. |
| 5,658,698 | A | 8/1997 | Yagi et al. |
| 5,723,353 | A | 3/1998 | Muenzel et al. |
| 5,798,283 | A | 8/1998 | Montague et al. |
| 5,815,051 | A | 9/1998 | Hamasaki et al. |

(Continued)

FOREIGN PATENT DOCUMENTS

EP 0 665 590 A2 8/1995

(Continued)

OTHER PUBLICATIONS

Storment, C.W., et al. "Flexible, Dry-Released Process for Aluminum Electrostatic Actuators." Journal of Microelectromechanical Systems, 3(3), Sep. 1994, p 90-96.

*Primary Examiner*—Lincoln Donovan
*Assistant Examiner*—Bernard Rojas
(74) *Attorney, Agent, or Firm*—Quarles & Brady LLP; R. Scott Speroff

(57) ABSTRACT

Microelectromechanical (MEMS) switches are used to implement a flying capacitor circuit transferring of electrical power while preserving electrical isolation for size critical applications where transformers or coupling capacitors would not be practical. In one embodiment, the invention may be used to provide input circuits that present a programmable input impedance. The circuit may be modified to provide for power regulation.

20 Claims, 6 Drawing Sheets

U.S. PATENT DOCUMENTS 5,834,864 A 11/1998 Hesterman et al.
5,847,280 A * 12/1998 Sherman et al. ..... 73/514.32
5,877,038 A 3/1999 Coldren et al.
5,880,921 A * 3/1999 Tham et al. ..... 361/233
5,920,978 A 7/1999 Koshikawa et al.
5,943,155 A 8/1999 Goossen
5,946,549 A 8/1999 Itoigawa et al.
5,955,932 A 9/1999 Nguyen et al.
5,959,516 A 9/1999 Chang et al.
5,995,688 A 11/1999 Aksyuk et al.
6,008,138 A 12/1999 Laermer et al.
6,060,336 A 5/2000 Wan
6,072,686 A * 6/2000 Yarbrough ..... 361/234
6,094,102 A 7/2000 Chang et al.
6,116,756 A 9/2000 Peeters et al.
6,127,767 A 10/2000 Lee et al.
6,144,545 A 11/2000 Lee et al.
6,149,190 A 11/2000 Galvin et al.
6,159,385 A 12/2000 Yao et al.
6,170,332 B1 1/2001 MacDonald et al.
6,188,322 B1 2/2001 Yao et al.
6,232,150 B1 5/2001 Lin et al.
6,236,281 B1 5/2001 Nguyen et al.
6,257,705 B1 7/2001 Silverbrook
6,265,238 B1 7/2001 Yaji et al.
6,276,205 B1 8/2001 McNie et al.
6,307,169 B1 * 10/2001 Sun et al. ..... 200/181
6,316,278 B1 11/2001 Jacobsen et al.
6,356,378 B1 3/2002 Huibers
6,356,689 B1 3/2002 Greywall
6,369,931 B1 4/2002 Funk et al.
6,373,682 B1 4/2002 Goodwin-Johansson
6,384,353 B1 5/2002 Huang et al.
6,391,742 B2 5/2002 Kawai
6,400,009 B1 6/2002 Bishop et al.
6,411,214 B1 6/2002 Yao et al.
6,417,743 B1 7/2002 Mihailovich et al.
6,428,713 B1 8/2002 Christenson et al.
6,463,339 B1 10/2002 Vasko
6,465,929 B1 10/2002 Levitan et al.
6,466,005 B1 10/2002 Yao et al.
6,497,141 B1 12/2002 Turner et al.
6,504,356 B2 1/2003 Yao et al.
6,547,973 B2 4/2003 Field
6,593,672 B2 * 7/2003 Ma et al. ..... 307/109
6,624,720 B1 * 9/2003 Allison et al. ..... 333/105
6,633,212 B1 * 10/2003 Ruan et al. ..... 335/78
2002/0017132 A1 2/2002 McNie et al.
2002/0021119 A1 2/2002 Yao et al.
2002/0158039 A1 10/2002 Harris et al.
2003/0132823 A1 * 7/2003 Hyman et al. ..... 335/78
2004/0095205 A1 * 5/2004 Schaffner et al. ..... 333/101

FOREIGN PATENT DOCUMENTS

EP 0 711 029 A2 5/1996
EP 0 763 844 A2 3/1997

* cited by examiner

MICROELECTROMECHANICAL ISOLATING CIRCUIT

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to microelectromechanical systems (MEMS) and in particular to MEMS for transferring electrical power while maintaining electrical isolation between the points of transfer.

MEMS are extremely small machines fabricated using integrated circuit techniques or the like. The small size of MEMS makes possible the mass production of high speed, low power, and high reliability mechanisms that could not be realized on a larger scale.

Often in electrical circuits, it is desired to transfer power between two points while maintaining electrical isolation between those points. Isolation, in this context, means that there is no direct current (DC) path between the points of transfer. Isolation may also imply a degree of power limiting that prevents faults on one side of the isolation from affecting circuitry on the other side of the isolation.

Conventional techniques of power transfer with electrical isolation include the use of transformers or capacitors such as may provide alternating current (AC) power transfer while eliminating a direct DC path.

There are drawbacks to these conventional techniques. First, when DC power must be transferred, additional circuitry (chopping) must be used to convert the DC input power to AC to be transferred by the transformer or capacitor. After transfer, further circuitry (rectification) must be used to convert the AC power back to DC power. This additional circuitry adds considerable expense. Second, the volume occupied by the capacitor or transformer may preclude its use in certain applications where many independently isolated circuits must be placed in close proximity or isolation is required-on a very small mechanical scale, for example, on an integrated circuit.

BRIEF SUMMARY OF THE INVENTION

The present invention employs MEMS structures to implement a "flying capacitor" circuit in which a capacitor is alternately connected to input and output terminals. The capacitor as switched provides a vehicle for the transfer of DC power while at no time creating a direct connection between input and output terminals. In the invention, the switches are MEMS switches which may be extremely small and operate at extremely high switching rates.

The charge on the flying capacitor may be used to activate the MEMS switch producing an extremely simple circuit. Alternatively, the MEMS switch may be operated by an external oscillator which may be controlled to provide a degree of power regulation in addition to isolation.

The invention is well adapted for use as an input circuit, for example, as input to a programmable logic controller and may, in that capacity, provide not only isolation but also a controllable input impedance allowing the input circuit to be used with different input voltage levels.

Specifically, the present invention provides in one embodiment an electrical isolator in which a MEMS switch array has an actuator receiving an actuator signal to alternately connect a capacitor between two input terminals and two output terminals. The MEMS switch array operates so that in a first switch state, the capacitor is connected to the input terminals and not to the output terminals and, in a second switch state, the capacitor is connected to the output terminals and not the input terminals. An actuator signal generator provides the actuator signal to repeatedly switch the MEMS switch array between a first and second state.

Thus, it is one object of the invention to provide an extremely small-scale power isolator.

It is another object of the invention to provide a power isolator that benefits from the high reliability and high switching speed of MEMS based switches.

The actuator signal generator can be a connection to the capacitor so that a predetermined voltage on the capacitor causes a switching of the MEMS switch array away from the first state to the second state.

Thus, it is another object of the invention to provide an extremely simple power isolator in which the charging of the capacitor serves to cause the switching action.

Alternatively, the actuator signal may be an electronic oscillator. The oscillator may communicate with the output terminals to provide an oscillator output that is a function of the electrical signal at the output terminal. For example, the oscillator may respond to a lower voltage on the output terminal to increase its frequency or duty cycle thus causing more charge to be transferred through the switching array.

Thus, it is another object of the invention to use the present power isolator to provide power regulation at the output terminal. By controlling the switching speed, current and/or voltage at the output terminal may be controlled.

The output terminals of the MEMS switch array may be attached to a shunt for discharging the capacitor in between transfers of charge from input to output terminals. This allows precise quantities of charge to be transferred, useful for passing an amount of charge corresponding to the voltage on the input conveying a better measure of the input voltage. The shunt also allows the effective impedance or resistance at the input to be controlled by accurately controlling the current flow into the input terminals for a given voltage. A controller may provide an actuator signal to the MEMS switch array to present a predetermined effective impedance at the input terminal that is essentially a reflection of the shunt impedance modulated by the switching of the switch array.

The predetermined resistance may be selected from a set of different predetermined resistances used with different input voltages. Alternatively, or in addition, a voltage sensor may be connected to the output terminals to communicate with the controller to change the predetermined effective resistance as a function of sensed voltage.

Thus, it is another object of the invention to provide an isolator that may control the effective input impedance at the input terminals while preserving isolation between input and output terminals. Such an isolator may be useful for input circuits that must present a certain load, for example, those used in a programmable logic controller.

These particular objects and advantages may apply to only some embodiments falling within the claims and thus do not define the scope of the invention.

DETAILED DESCRIPTION OF THE PREFERRED EMBODIMENT

Figure 1:
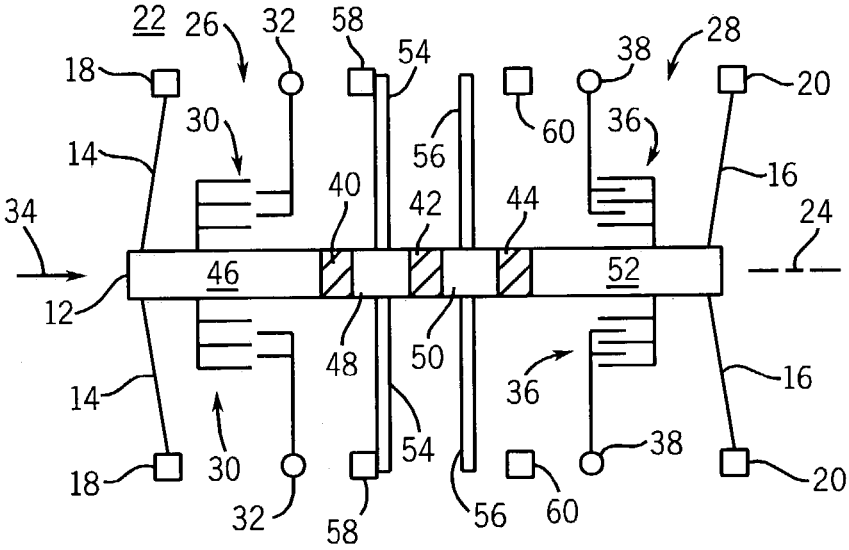
FIG. 1 is a simplified top view diagram of a MEMS double pole, double throw switch suitable for use with the present invention showing the switch in a first state.

Referring now to FIG. 1, a MEMS double pole, double throw switch 10 may include a longitudinal beam 12 supported on two pairs of transverse arms 14 and 16 extending from opposite sides of opposite ends of the longitudinal beam 12. The transverse arms 14 and 16 are also attached to stationary pylons 18 and 20 that are fixed with respect to an underlying substrate 22. As supported by flexing of the transverse arms 14 and 16, the longitudinal beam 12 is free to move along a longitudinal axis 24.

The longitudinal beam 12 may support an input actuator 26 and a bias actuator 28. As shown, the input actuator 26 is positioned at the end of the longitudinal beam 12 near transverse arms 14 and consists of two pairs of interdigitated capacitor plates 30. One half of each pair of interdigitated capacitor plates 30 are supported by the longitudinal beam 12 extending in opposite directions from the longitudinal beam 12. The remaining half of each pair of interdigitated capacitor plates 30 are supported by terminals 32 attached to the underlying substrate 22.

As will be understood in the art, voltage potential placed on these interdigitated capacitor plates 30 will cause a force so as to induce a rightward movement of the longitudinal beam 12 as indicated by arrow 34.

The bias actuator 28 is constructed of interdigitated capacitor plates 36 similar to capacitor plates 30 described above but positioned on longitudinal beam 12 near the transverse arms 16. Again, half of each pair of interdigitated capacitor plates 36 extend transversely from opposite sides of the longitudinal beam 12 and the other half of each pair of interdigitated capacitor plates 36 are supported by terminals 38 affixed to the substrate 22.

The structure described thus far may be generally constructed of silicon, a semiconductor, and fabricated using MEMS fabrication techniques. However, the longitudinal beam 12 also includes, from left to right, three sections of insulating material 40, 42 and 44 separated along its length. The insulating material may be, for example, silicon dioxide. The remaining structure may be metallized so that the three sections of insulating material 40, 42 and 44 separate the longitudinal beam 12, from left to right, into four conductive regions 46, 48, 50 and 52. In an alternative embodiment, insulating section 42 may be omitted provided the switch operates in a break before make mode. Additional variations are described below.

Conductive region 46 provides an electrical path from pylons 18 through transverse arms 14 to half of the capacitor plates 30 thus, providing a way to bias the input actuator 26 through pylons 18 and 32. Conversely, conductive region 52 provides electrical connection through pylon 20, transverse arms 16 to half of capacitor plates 36 providing electrical connection to the bias actuator 28 through terminal 38 and pylon 20.

Extending transversely on opposite sides of conductive region 48 are contact bars 54 (also metallized) and extending transversely on opposite sides from conductive region 50 are contact bars 56. In a first position, indicated in FIG. 1, contact bars 54 touch stationary contact 58 extending upward from the substrate. Conversely, in the first state, contact bars 56 do not touch adjacent stationary contact 60 also extending upward from the substrate. As will be described below with respect to FIGS. 15 and 16, a single bar structure is also contemplated. The dual bar structure described here, however, may provide some benefits in increasing the separation of stationary contacts 58 and 60 and allowing optimization of the bars to create an oxide removing "wiping" action described below.

The resistance between stationary contact 58 and contact bar 54, when touching, may be decreased by a side surfaced metallization communicating with the upper surface metallization. This side surface metallization may be produced by etching a cavity next to the contact bars 54 and stationary contact 58 before their release from the substrate material. The side surface metallization may also be produced by plating a metal such as Al, Ni, Cu, Au, Ag onto the stationary contacts. The cavity may be filled with a metal compound such as aluminum or copper according to techniques well known in the art.

Figure 2:
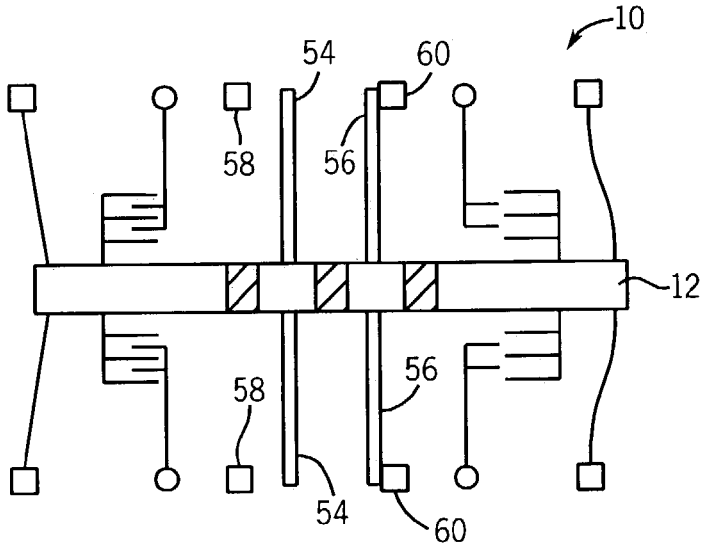
FIG. 2 is a view similar to that of FIG. 1 showing the switch in the second state as moved by an actuator operating against a bias.

Referring now to FIG. 2, in a second position in which the longitudinal beam 12 is displaced to the right, contact bar 56 will touch stationary contact 60 while contact bars 54 will be separated from stationary contact 58. Because contact bars 54 and 56 are isolated from each other, yet each of contact bars 54 and 56 are connected by a conductive region 50 and 48, an effective double pole—single throw switch is created where the throws are stationary contact 58 and 60. The construction of this switch is so that it is "break before make", that is, contact bars 54 and 56 are never contacting their respective stationary contacts 58 and 60 at the same time.

Referring again to FIG. 1, motion of the longitudinal beam 12 in the rightward direction may be produced by applying a voltage across pylons 18 and 32 causing a drawing together of the interdigitated fingers of capacitor plates 30. Conversely, motion to the left per FIG. 1 may be produced by a corresponding voltage on terminals 38 and 20 causing a drawing together of interdigitated capacitor plates 36. These capacitor plates 30 and 36 may be alternately energized (alternately energizing the input actuator 26 and the bias actuator 28) to move the longitudinal beam 12 left and right. Alternatively, the bias actuator 28 may be used to exert a fixed force at all times providing an effective spring force biasing the longitudinal beam 12 to the left. The fixed force of the bias actuator 28 may then be overcome by greater voltage applied to the capacitor plates 30 of the input actuator 26 when the longitudinal beam 12 is to be moved.

The MEMS switch 10 so created is symmetrical providing for improved fabrication tolerances.

Figure 3:
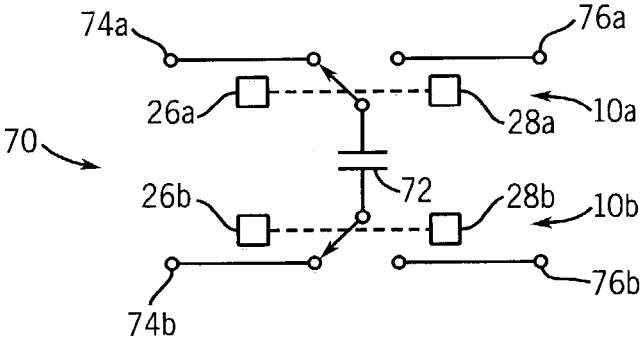
FIG. 3 is a schematic of a MEMS flying capacitor circuit in which a capacitor may be switched between input and output terminals to transfer power by the MEMS switches of FIGS. 1 and 2.

Referring now to FIG. 3, the MEMS switch of FIGS. 1 and 2, or other MEMS switches well known in the art, may be used to construct a flying capacitor circuit 70 in which one MEMS switch 10*a* provides a connection between one end of a capacitor 72 with either of an input terminal 74*a* or an output terminal 76*a* under the influence of the input actuator 26*a* operating against bias actuator 28*a*.

Similarly, a second MEMS switch 10*b* provides a connection between the other end of a capacitor 72 with either of an input terminal 74*b* or an output terminal 76*b* under the influence of the input actuator 26*b* operating against bias actuator 28*b*. During operation, the capacitor 72 is connected first with both input terminals 74*a* and 74*b* to charge the capacitor 72 from an input voltage source, and then it is disconnected from input terminals 74*a* and 74*b* and connected to output terminals 76*a* and 76*b* for discharge. The operation of the MEMS switches is such as to eliminate any instantaneous current path between terminals 74 and 76. In this way, power is transferred from input terminal 74 to output terminals 76 while maintaining complete isolation between terminals 74 and terminals 76. As will be seen, the switching action also provides limitations on current flow and voltage transfer that can reduce noise transmission and the effects of overvoltage on the input.

The circuit of FIG. 3 as implemented with MEMS devices 10*a* and 10*b* provides not only an extremely small power isolator, such as would be impractical or cumbersome to construct from a standard transformer or capacitor network, but it also provides a power isolator which allows a transfer of direct current without transformation into alternating current. The small size of the MEMS device makes this structure practical for integrated circuit size systems or situations in which a high number of instrumentation input (e.g. isolators) is needed in a relatively small space such as an industrial control, laboratory test systems, or aircraft, ship, and vehicle systems. The high switching speed of MEMS switches also allows the capacitor 72 to be modestly sized yet still allowing useful power transfer. Unlike some methods of power or signal isolation, the MEMS device so produced allows for bi-directional flow of power either from input terminals to output terminals or from output terminals to input terminals as may be useful in certain applications.

Figure 6:
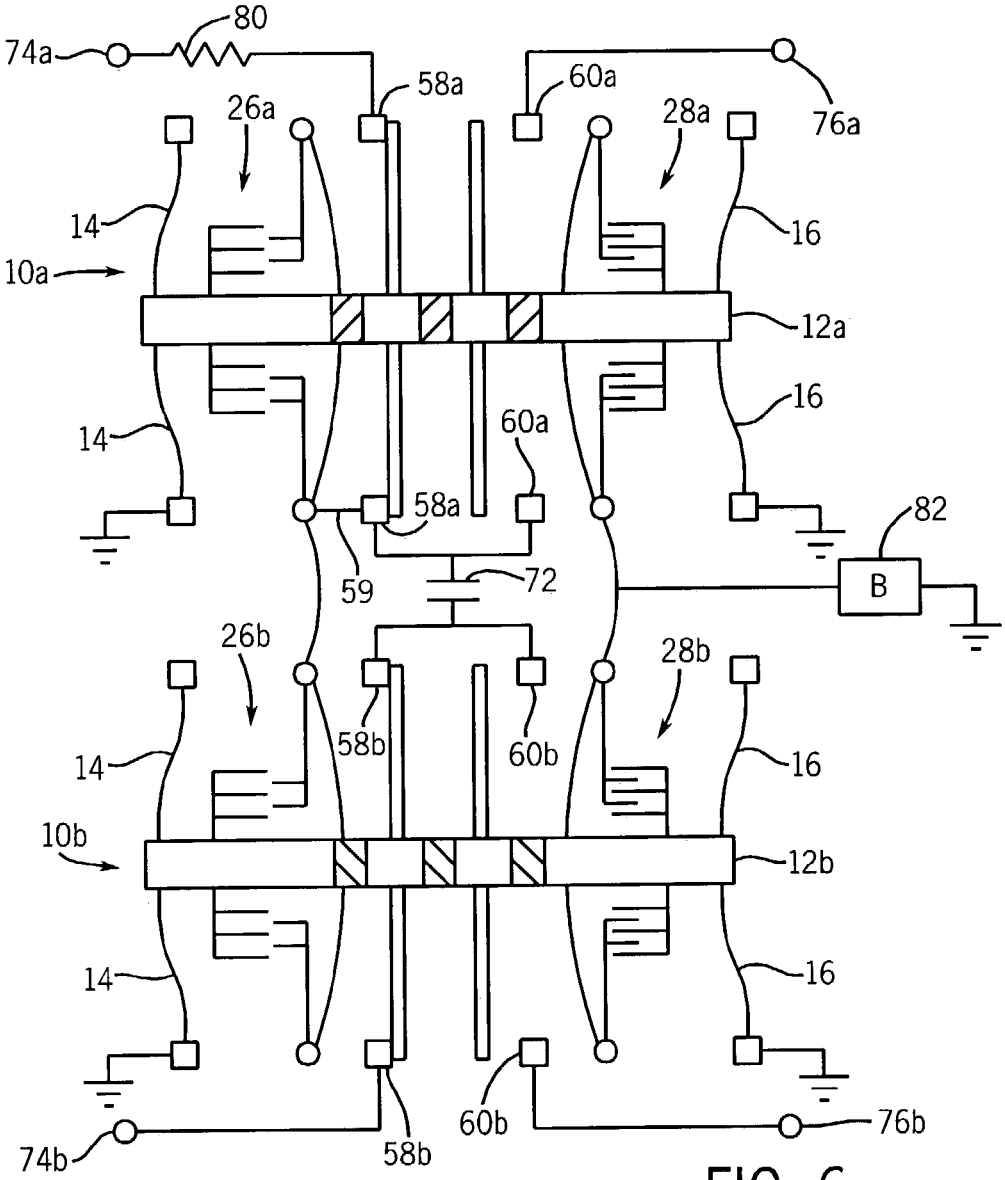
FIG. 6 is a circuit composed of two of the switches of FIGS. 1 and 2 implementing the flying capacitor circuit of FIG. 3 where the charge on the flying capacitor activates the MEMS switches.

Referring now to FIG. 6, in one embodiment, using the switches described above, the MEMS circuit of FIG. 3 may be implemented by wiring a first MEMS switch 10*a* so that input terminal 74*a* connects through a limiting resistor 80 to a stationary contact 58*a* of the MEMS switch 10*a*. The limiting resistor 80 allows control of peak in-rush current flow through the MEMS switches when the capacitor 72 is uncharged. Remaining input terminal 74*b* may connect to stationary contact 58*b* of MEMS switch 10*b*. Conversely, output terminal 76*a* may connect to stationary contact 60*a* of MEMS switch 10*a* and stationary contact 76*b* may connect to stationary contact 60*b* of MEMS switch 10*b*. The yet uncommitted stationary contact 58*a* and 60*a* of MEMS switch 10*a* can be joined together and attached to one side of capacitor 72 whereas the uncommitted stationary contact 58*b* and 60*b* of MEMS switch 10*b* may be joined and connected to the opposite side of capacitor 72.

Motion of the longitudinal beams 12*a* and 12*b* of MEMS switch 10*a* and MEMS switch 10*b*, respectively, in unison left and right, implement the circuit of FIG. 3.

As mentioned, the high rate of switching possible by MEMS switch 10*a* and MEMS switch 10*b* allow significant power flow from the input terminals 74 to the output terminals 76 with a relatively small capacitor 72 such as may be fabricated on the substrate of the MEMS switches 10*a* and 10*b*. Alternatively, capacitor 72 may be located externally allowing greater transfer of power limited only by the current capabilities of the MEMS switches 10*a* and 10*b*.

Generally, the activation of the MEMS switches 10*a* and 10*b* may be under the influence of an oscillator attached either to one or both of the input actuator 26 and the bias actuator 28 of MEMS switches 10*a* and 10*b*. In one embodiment, however, the capacitor 72 may provide the voltage to the bias actuator 28 of MEMS switches 10*a* and 10*b* via connection 59 as shown. In this embodiment, a constant bias voltage from bias voltage 82 may be attached to the bias actuator 28 of MEMS switches 10*a* and 10*b*.

Figure 7:
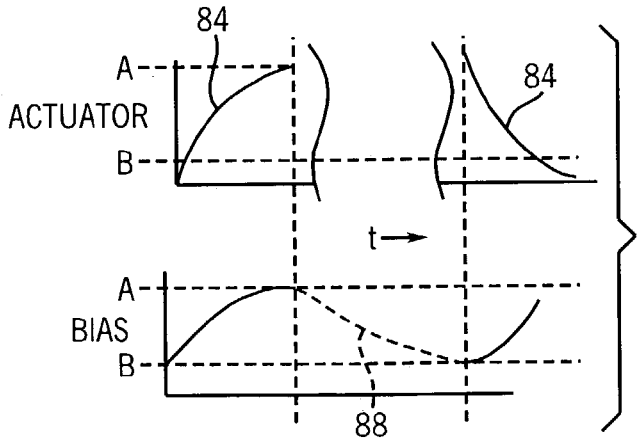
FIG. 7 is two graphs, the upper graph showing the charge on the flying capacitor of the circuit of FIG. 6 as a function of time, and hence the force of the actuator as a function of time, and the lower graph showing the bias force resisting the actuator as a function of movement of the mechanical elements of the MEMS switch.

Referring now to FIGS. 1, 6, and 7 during operation, the voltage on the capacitor 72 initially rises as energy is conducted through input terminals 74*a* and 74*b* with the longitudinal beams 12*a* and 12*b* in their leftmost position. With this voltage rise, the actuator force 84 increases. At a first threshold force (A), the longitudinal beam 12*a* may snap rightward against the bias force 88 to a left position to be connected to output terminal 76*a* and 76*b* where the voltage drops on the capacitor 72 as it is discharged to below a return threshold force (B). Once the voltage on the capacitor 72 drops sufficiently so that the actuator force 84 is below the return threshold force (B), the beam 12 snaps leftward to resume the charging cycle again. The snap points change depending on the direction of movement of the beam 12*a* creating hysteresis.

Key to this self-actuation is that the resisting force 88 be made to abruptly decrease to the value (B). This may be accomplished by use of an over-center spring provided by bowed transverse arms 14 and/or 16 described below with respect to FIG. 5.

Thus, the action of charging and discharging of the capacitor 72 forms the oscillator for driving the longitudinal beams 12*a* and 12*b* from the leftmost position to the rightmost position and back again. The speed of the switching will be determined in part by the amount of power flow as reflected in the charge and discharge rate of the capacitor 72. Thus, the power transfer will be on demand.

It is also possible using this technique to add a simple counter to record the number of times the capacitor has achieved a predetermined threshold voltage producing threshold force (A). The total recorded number of switching cycles can provide an approximate, digital value of the input voltage without the use of an analog-to-digital converter. Other inherent benefits of using a counter such as efficiency, power consumption, and speed are also available with this technique.

Figure 4:
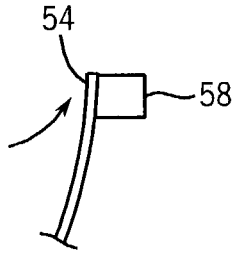
FIG. 4 is a fragmentary detail of a contact of one pole and a corresponding throw of the switch of FIGS. 1 and 2 showing an oblique angling of a contact bar of the pole to create a wiping action with the contact of the throw.

Referring now to FIG. 4, the contact bars 54 may be bowed slightly in its interface to stationary contact 58 so that longitudinal motion of the contact bar 54 in over travel (after contact) causes a slight transverse wiping action such as cleans oxide from the metallic surfaces. Alternatively or in addition, the contacts 58 and/or 60 may be shaped to increase the wiping action as described below with respect to FIG. 16.

Figure 5:
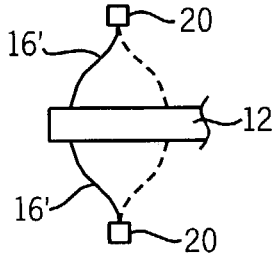
FIG. 5 is a fragmentary view of a transverse arm supporting a moving portion of the MEMS switch of FIG. 1 wherein the transverse arm acts as an over center spring.

Referring to FIG. 5, as mentioned, an elongated and bowed transverse arm 16' may provide for monostable or bistable biasing with the monostable biasing always providing a force in one direction, for example, leftward, and the bistable biasing providing force toward the direction in which the beam is most fully extended. The force provided by the bowed transverse arm 16' may be offset by the applied bias force from bias actuator 28 allowing greater control of the function of the resisting force 88.

Figure 8:
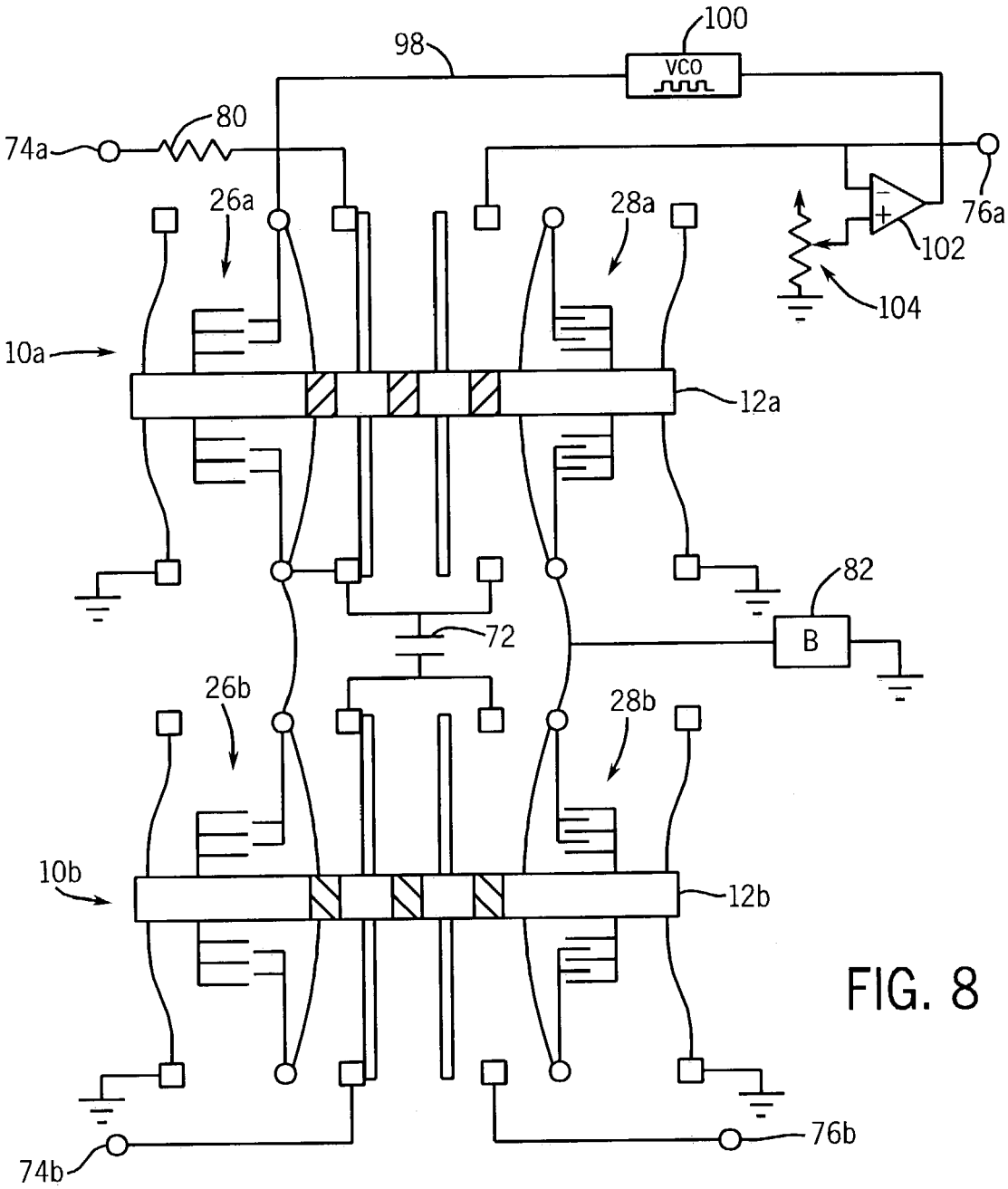
FIG. 8 is a figure similar to that of FIG. 6 showing an alternative embodiment in which an electric oscillator operates the MEMS switches and wherein the oscillator may be controlled to provide output power regulation.

Referring now to FIG. 8 in an alternative embodiment, the operation of the longitudinal beams 12*a* and 12*b* of MEMS switches 10*a* and 10*b* may be under control of an electronic oscillator 100 connected directly to the input actuators 26*a* and 26*b* of MEMS switches 10*a* and 10*b* (or alternatively to the bias actuators 28*a* and 28*b* or the combination of both). The speed of the oscillator 100 thus determines the speed at which the switching action caused by motion of longitudinal beams 12*a* and 12*b* occurs.

In this embodiment, the voltage at the output terminal 76*a* may be optionally monitored by a differential amplifier 102 and compared to a desired reference voltage 104. The output of the differential amplifier 102 may then be provided to the oscillator 100 which may be a voltage controlled oscillator so as to increase the switching speed as the voltage on the output terminal 76*a* drops below the desired reference voltage 104. A higher switching speed may increase the power throughput and in this way, output voltage and/or current regulation may be achieved.

Figure 9:
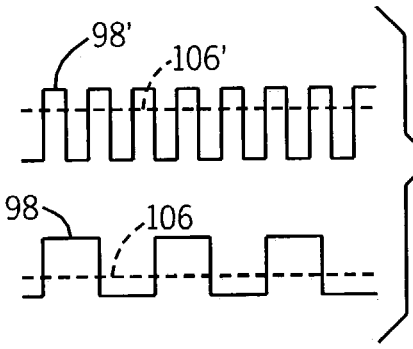
FIG. 9 is two graphs of the output voltage of the circuit at FIG. 8, the upper graph showing a rapid switching speed producing a high average current or voltage and the lower graph showing a slower switching speed producing a lower average current or voltage.

For example, referring to FIG. 9, the output 98 of the oscillator 100 may be of low frequency providing an effective low average transfer of energy 106 through capacitor 72 to the output terminals 76. Conversely, a higher switching frequency of output 98' provides a correspondingly higher average transfer of energy 106'. Alternatively, and as will be understood in the art, the duty cycle of the output 98 may be controlled instead of the frequency.

Figure 10:
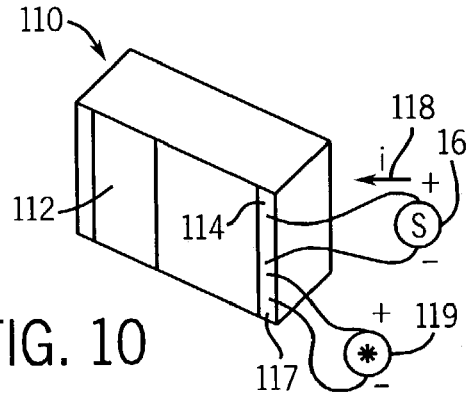
FIG. 10 is a simplified perspective view of the exterior of an industrial controller showing the connection of input circuitry of the industrial controller to an external sensor, the input circuitry presenting a predetermined input impedance to the sensor.

Referring now to FIG. 10, an application of particular interest for the circuit structure that has been described is a programmable logic controller 110 such as may include an industrial computer 112 and one or more input circuits 114 and output circuits 117.

The input circuits 114 may provide a connection to an external sensor 116 that produces a voltage indicating a high or low state or an analog value indicating a number within a range by resolving the charge on capacitor 72 to the desired number of bits. The sensor 116 may require a particular input resistance at the I/O circuit 114 such as allows a predetermined current flow 118.

Generally, such input circuits 114 may be designed for use with a specific input voltage. For example, different input circuits 114 may be required for the DC voltages of 5 volts, 12 volts, 24 volts, 48 volts, and 125. Similarly, different input circuits 114 are used for the AC voltages of 120 volts, and 230 volts. Each of these input circuits has a different switching threshold and different input impedance which requires the manufacturer to construct and stock a number of different input circuits or modifications.

Generally, output circuits 117 are designed for use with a specific output voltage (AC output or DC output). The output circuits 117 may provide a connection to an external actuator or indicator 119 that receives a voltage for example, a high or low state or an analog voltage, within a predefined range.

Figure 11:
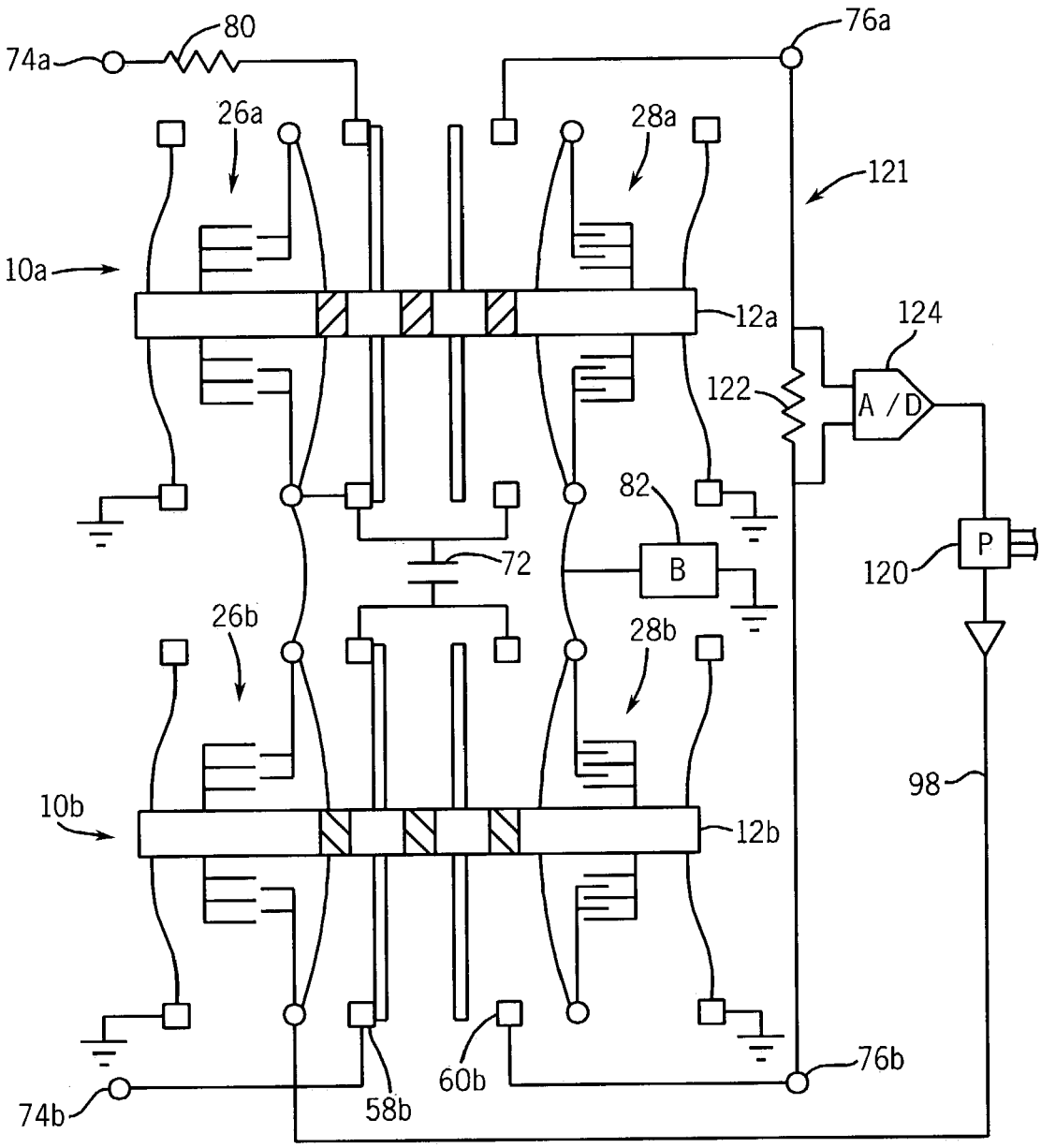
FIG. 11 is a circuit similar to that of FIGS. 6 and 7 showing use of the MEMS switch array having an output shunt to provide a power isolator providing a controllable input resistance.

The device shown in FIG. 11 may serve to provide a switched and/or regulated output voltage by connecting a source voltage supplied by the programmable logic controller 110 to the input terminals 74*a* and 74*b* and connecting the actuator or indicator 119 to the output terminals 76*a* and 76*b*. The switching time of the MEMs device may be altered to provide a generally scalable output voltage supply that is programmable over a wide range. Furthermore, this may be dynamically scalable based on signal noise, changes in operating conditions, or new process requirements. Similarly, the following described circuits may be equally used as input and outputs as will be understood from the description to those of ordinary skill in the art.

Referring now to FIG. 1, the present circuit may be adapted to provide an input circuit 121 for multiple voltages and for AC and DC voltages. In this embodiment, a processor 120 provides an oscillator signal output 98 communicating with the input actuator 26 of MEMS switches 10*a* and 10*b* in the manner described above with respect to the oscillator 100 of the embodiment of FIG. 8.

Output terminals 76*a* and 76*b* are connected to a shunting resistor 122 having a value lower than the input impedance required for the lowest voltage range in which the input circuit 121 is intended to operate. An analog to digital converter 124 allows charge flowing across the shunting resistor 122 and the output terminal 76*a* and 76*b* to be measured, for example, by integrating the decaying voltage across the shunting resistor 122 or other charge measurement techniques well known to those of ordinary skill in the art.

Figure 12:
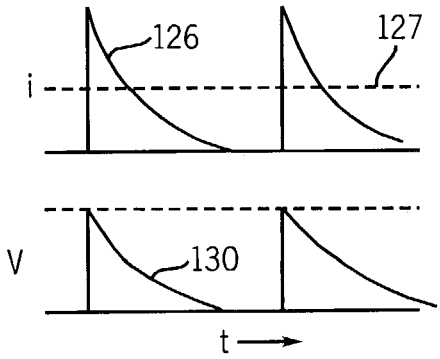
FIG. 12 is two graphs, the upper graph plotting of the current on the output terminals of the circuit of FIG. 11 and showing average current flow such as defines an effective input resistance and the lower graph showing measurement of peak voltage on the output terminals to deduce input voltage.

Referring also to FIG. 12, the processor 120 may provide an output measurement of the input voltage derived from the transferred charge. The processor may also be programmed with the desired voltage range of the input circuit 121 to provide an oscillator signal output 98 that causes a switching of the capacitor 72 to produce, through its periodic current transfer, a predetermined average current flow 127 into the input terminals 74*a* and 74*b* through resister 80. The average current flow 127 is determined by the size of capacitor 72 and the switching rate of the capacitor 72 as will be understood by those of ordinary skill in the art. The average current 127 is selected so that for the desired voltage range applied to terminal 74*a* and 74*b* of the input circuit 121, the switching simulates an effective resistance equal to the desired input impedance. The effective impedance is simply the average current flow 127 divided into the applied voltage.

A measurement of the voltage presented at input terminals 74*a* and 74*b* of the input circuit 121 may be determined by the analog to digital converter 124 at the instant of switching of the capacitor 72 to the output terminals 76*a* and 76*b* and will be the peak of the voltage wave form 130 at the output terminals 76*a* and 76*b*. The resultant digital value may be compared against a predetermined switching threshold (also programmed into the processor 120) to provide for discrimination between logically high and logically low states.

In an alternative embodiment, the processor 120 may detect the peak voltage readings of waveform 130 from the analog to digital converter 124 and use this peak reading to select an impedance, and thus no preprogramming of the input circuit 121 need be performed.

Figure 13:
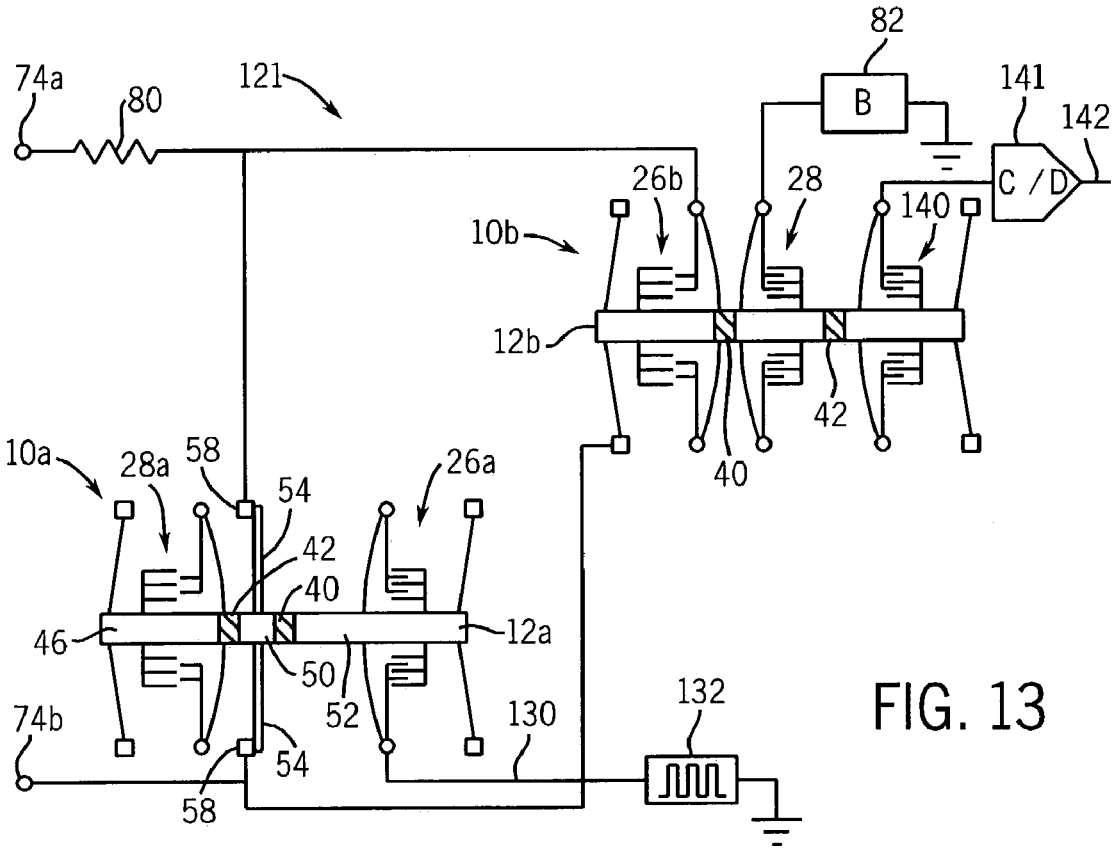
FIG. 13 is an alternative embodiment of the circuit of FIG. 11 in which a first MEMS switch added to the input side of the circuit provides a path to ground to control the input resistance and a second MEMS circuit operates with a predetermined bias to provide isolated digital detection of the input voltage without electrical connection.

Referring now to FIG. 13, in an alternative embodiment of the input circuit 121, the MEMS structure is utilized to provide the threshold detection that processes the input voltage to distinguishing between high and low input voltage states. In this embodiment, the input terminals 74*a* and 74*b* are shunted by the series combination of the limiting resister 80 and one throw of a MEMS switch 10*a* providing stationary contacts 58 connected by contact bars 54. The input actuator 26 of MEMS switch 10*a* is connected to an oscillator 132 that may be adjusted so as to provide an effective input impedance to the input circuit 121 being the value of the limiting resister 80 divided by the duty cycle of the wave form 130 from oscillator 132. Thus, if switch 10*a* is closed 50% of the time, the value of the limiting resistor 80 appears to effectively be doubled.

Limiting resistor 80 also connects with an input actuator 26 of a second MEMS switch 10*b* also having a bias actuator 28 and sensing structure 140 attached to longitudinal beam 12*b* and each isolated from the others by insulating materials 40 and 42. Such devices and their fabrication are described, for example, in U.S. Pat. No. 6,159,385 entitled: "Process for Manufacture of Micro Electromechanical Devices Having High Electrical Isolation" and U.S. applications Ser. No. 10/002,725 entitled: "Method for Fabricating an Isolated Microelectromechanical System Device"; and Ser. No. 09/963,936 entitled: "Method for Constructing an Isolated Microelectromechanical System Device using Surface Fabrication Techniques" hereby incorporated by reference.

At times when the switch of MEMS switch 10*a* is open, the voltage at input terminal 74*a* is seen at the capacitor plates of input actuator 26*b* and causes a force tending to move the longitudinal beam 12*b* of device 10*b* leftward against the biasing force of the bias actuator 28*b* provided by a bias voltage 82. The bias voltage sets the switching threshold of the MEMS switch 10*a* and thus the threshold of the input circuit 121.

When the force caused by the input actuator 26*b* exceeds the force of the bias actuator 28*b*, the longitudinal beam 12*b* moves left. This motion may be sensed by the sensing structure 140 and decoded by a capacitance to digital decoders circuit 141 to produce an output activation signal 142.

In this structure, two MEMS switches 10*a* and 10*b* allow independent setting of an input impedance and threshold voltage through the setting of oscillator 132 and bias voltage 82. Both of these may be controlled by inputs from a processor (not shown) to allow automatic reconfiguration of the input circuit 121 for different expected voltages.

Figure 14:
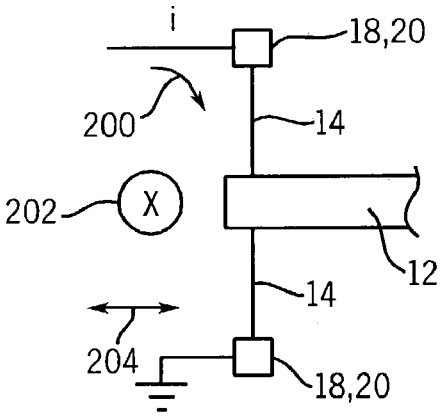
FIG. 14 is a fragmentary view similar to that of FIG. 5 showing a Lorenz force actuator that may also be used in the present invention.

Referring briefly to FIG. 14, the input actuators 26, bias actuators 28 and sensing structures 140 are not limited to the described electrostatic mechanism of opposed capacitor plates as has been described but may be any of a variety of structures including piezoelectric, electromagnetic, electrostrictive and thermally activated structures known in the art. The input and bias actuators 26 and 28 can also be realized using the Lorentz force mechanism by passing a current 200 along the transverse arms 14 between pylons 20, for example, in the presence of a magnetic field 202 to create a longitudinal Lorentz force 204 moving the longitudinal beam 12. The sensing structure 140, in contrast, senses current 200 caused by the movement of the transverse arms 14.

Figure 15:
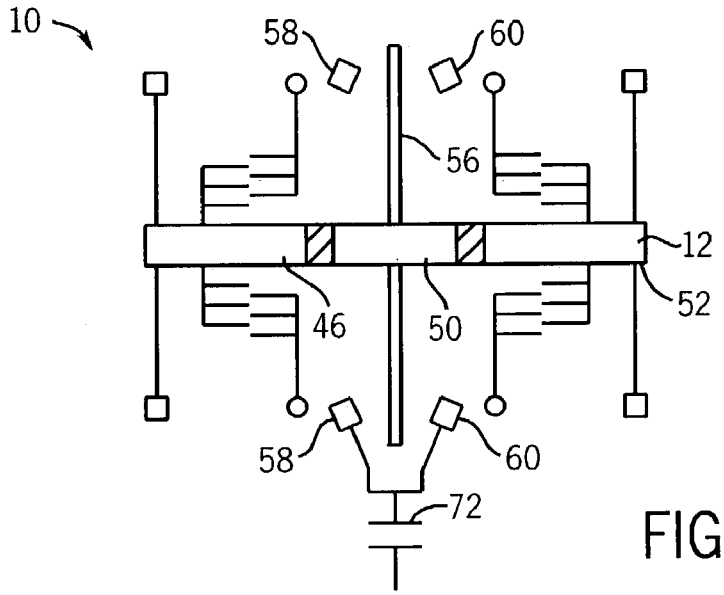
FIG. 15 is a figure similar to that of FIG. 1 showing a simplified embodiment of a MEMS switch suitable for the present invention.

Referring now to FIG. 15, the MEMS switch 10 of FIGS. 1 and 2 may be simplified by eliminating one of the contact bars (54) and moving the stationary contacts 58 and 60 closer together so that one contact bar 56 can contact alternately with either stationary contact 58 or stationary contact 60 at the ends of travel of the longitudinal beam 12 (shown in FIG. 15 centered within its travel range). This switch, unlike the single pole single throw switches of FIG. 13 naturally will enforce a break-before-make connection between the capacitor 72 and the input terminals 74 and output terminals 76.

Figure 16:
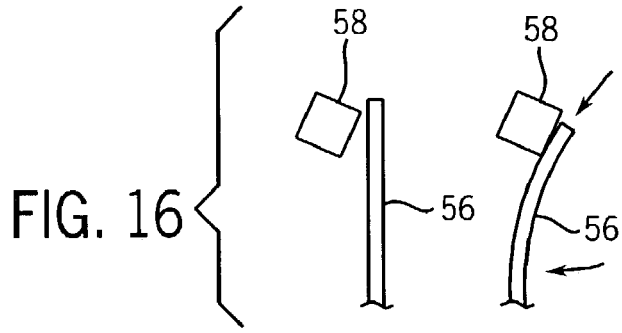
FIG. 16 is a figure similar to that of FIG. 4 showing an alternative method of obtaining a wiping action between electrical contact surfaces.

Referring to FIG. 16, the contact bar 56 in the switch of FIG. 15 cannot be bowed as shown in FIG. 4 but as has been mentioned, the contacting faces of the stationary contacts may be canted so as to promote a backward powering of the contact bar 56 causing a wiping action of the contact bar 56 across the canted surface of the stationary contacts 58 and 60.

Figure 17:
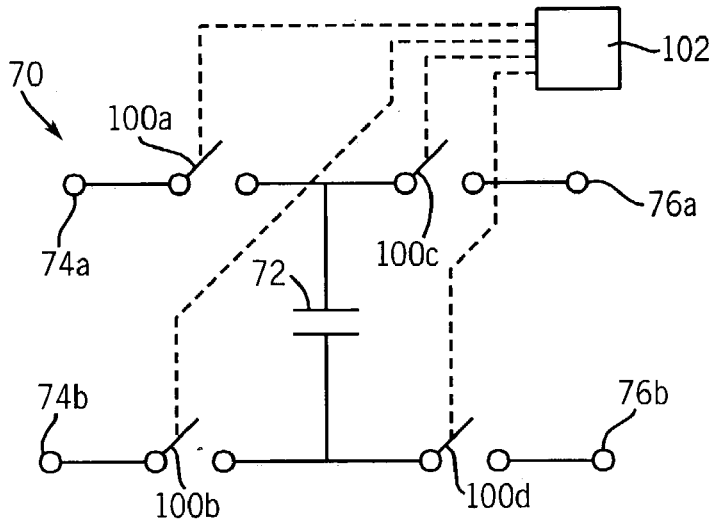
FIG. 17 is a figure similar to that of FIG. 3 showing implementation of the flying capacitor circuit using single-pole, single-throw MEMS switches.

Referring now to FIG. 17, in an alternative embodiment of the flying capacitor circuit 70, the capacitor 72 may be alternately connected across the input terminals 74*a* and 74*b* and output terminals 76*a* and 76*b* by four single pole single throw MEMS switches 100*a–d* where switches 100*a* and 100*b* close to connect opposite terminals of capacitor 72 to terminals 74*a* and 74*b*, and switches 100*c* and 100*d* close to connect opposite terminals of capacitor 74 to output terminals 76*a* and 76*b*. The switches need not be in mechanical communication but may be activated by a controller 102 providing closing signals to the switches 100*a–d* to alternately close pair 100*a* and 100*b*, then 100*c* and 100*d*, so that each pair opens before the next pair closes in a make-before-break configuration. Such MEMS switches may be manufactured by a variety of techniques one of which is described in U.S. Pat. No. 5,880,921 entitled: Monolithically Integrated Switched Capacitor Bank using Micro Electro Mechanical System (MEMS) Technology and hereby incorporated by reference.

It is specifically intended that the present invention not be limited to the embodiments and illustrations contained herein, but include modified forms of those embodiments including portions of the embodiments and combinations of elements of different embodiments as come within the scope of the following claims. For example, the devices described may be operated in series or in parallel with other similar devices to increase their voltage or current handling capacity. This approach can in the case of parallel operation also provides redundancy in the event of a single device failure and the potential opportunity for dynamic reconfiguration.

While the preferred embodiment described above is a planar device that operates laterally, the present invention can also operate in the vertical plane, for example, using cantilevered switch elements with capacitor devices connected at the end of the cantilevered beam. Other geometries are also possible, for example, those operating in rotation using a micromotor or an electrostatic driven MEMs motor. Such a device could employ multiple spokes (such as 4 or 8) and capacitor devices at the end of the moving spokes could also provide the charging/discharging cycle described in this application. For example, as the micromotor turned one capacitor spoke could be charging up while another one was discharging. The micromotor could rotate continuously or index to different spoke positions.

The MEMs isolation devices described herein could be fabricated on a common "floating" MEMs base to make them less sensitive to machinery vibration.

We claim:

1. An electrical isolator comprising:

a MEMS switch array having an actuator receiving an actuator signal to alternately connect a capacitor between two input terminals and two output terminals, the MEMS switch array operating so that in a first switch state, the capacitor is connected to the input terminals and not the output terminals, and in a second switch state, the capacitor is connected to the output terminals and not the input terminals; and an actuator signal generator providing the actuator signal to repeatedly switch the MEMS switch array between the first and second states wherein input terminals are electrically isolated from the output terminals.

2. The electrical isolator of claim 1 wherein the actuator signal generator is a connection to the capacitor so that a predetermined voltage on the capacitor causes a switching of the MEMS switch array from the first state to the second state.

3. The electrical isolator of claim 1 wherein the actuator signal generator is an electronic oscillator.

4. The electrical isolator of claim 1 wherein the electronic oscillator is adjustable to provide an oscillator output that adjustably controls electrical power at the output terminal.

5. The electrical isolator of claim 1 wherein the electronic oscillator communicates with the output terminals to provide an oscillator output that is a function of the electrical signal at the output terminal to provide regulation of electrical power at the output terminal.

6. The electrical isolator of claim 1 wherein the switch array is constructed from four single pole single throw switches.

7. The electrical isolator of claim 1 wherein the switch array includes at least one beam supported on flexible transverse arms to move longitudinally above a substrate, the beam carrying at least one transversely extending contact arm to connect and disconnect from a stationary contact pylon extending from the substrate.

8. The electrical isolator of claim 7 having at least two contact arms extending transversely from the beam in opposite directions to alternately connect and disconnect from respective corresponding stationary contact pylons extending from the substrate, wherein the contact arms are sized and placed so that beam and contact arms are longitudinally and transversely symmetrical.

9. The electrical isolator of claim 7 wherein the actuator is selected from the group consisting of: a Lorentz actuator, an electrostatic actuator, a piezoelectric actuator, or a thermal actuator.

10. The electrical isolator of claim 7 wherein the beam supported one or more pairs of flexible transverse arms extending in a bow to present force increasingly resisting longitudinal motion of the beam in a first direction up to a snap point after which the force abruptly decreases.

11. The electrical isolator of claim 10 wherein the snap point changes as a function of direction of motion on the beam.

12. A MEMS device comprising:

a MEMS switch array receiving at least one actuator signal to alternately connect a capacitor between two input terminals and two output terminals, the MEMS switch array operating so that in a first switch state, the capacitor is connected to the input terminals and not the output terminals and in a second switch state, the capacitor is connected to the output terminals and not the input terminals, wherein the switching of the MEMS switch array is according to at least one actuator signal;

a shunt for discharging the capacitor when it is connected to the output terminals, either transferring the charge to the supply return or to a supply capacitor for subsequent use in powering circuitry; and a controller providing the actuator signal to the MEMS switch array to control the duty cycle of switching to present a predetermined effective impedance at the input terminal.

13. The MEMS circuit of claim 12 wherein the predetermined resistance may be selected from among a set of different predetermined resistances suitable for different input voltages.

14. The MEMS circuit of claim 12 including further a resistance in series with the input terminals.

15. The MEMS circuit of claim 12 including further a voltage sensor connected to the output terminals and communicating with the controller to change the predetermined effective resistance as a function of sensed voltage.

16. A method for electrically isolated power transfer comprising the steps of:

(a) at a first time, connecting a first and second terminal of a capacitor to corresponding input terminals using a MEMS switch array;

(b) at a second time, connecting the first and second terminal of the capacitor to corresponding output terminals using the MEMS switch array; and (c) repeating steps (a) and (b) repeatedly;

whereby electrical power may be transferred between the input terminals and the output terminals while maintaining electrical isolation between the input and output terminals.

17. The method of claim 16 wherein the repetition of step (c) occurs at a regular interval.

18. The method of claim 16 wherein the repetition of step (c) occurs at a variable interval related to a transfer of power from the output terminals to a connected circuit thereby providing electrical regulation of power.

19. The method of claim 16 wherein the switch array is constructed from four single-pole, single-throw switches.

20. The method of claim 16 wherein the switch array includes at least one beam supported on flexible transverse arms to move longitudinally above a substrate, the beam carrying at least one transversely extending contact arm to connect and disconnect from a stationary contact pylon extending from the substrate.

* * * * *

UNITED STATES PATENT AND TRADEMARK OFFICE

CERTIFICATE OF CORRECTION

PATENT NO. : 6,975,193 B2
DATED : December 13, 2005
INVENTOR(S) : Knieser et al.

It is certified that error appears in the above-identified patent and that said Letters Patent is hereby corrected as shown below:

Column 8,
Line 43, "Fig. 1" should be -- Fig. 11 --.

Signed and Sealed this

Twenty-fifth Day of April, 2006

JON W. DUDAS
*Director of the United States Patent and Trademark Office*